US006328116B1

(12) United States Patent
Hurskainen et al.

(10) Patent No.: US 6,328,116 B1
(45) Date of Patent: Dec. 11, 2001

(54) ARRANGEMENT IN CONNECTION WITH A HYDRAULIC BREAKING APPARATUS

(75) Inventors: Arvo Hurskainen, Lahti; Timo Sippus, Hollola, both of (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 09/191,776

(22) Filed: Nov. 13, 1998

(30) Foreign Application Priority Data

Dec. 11, 1997 (FI) ..... 974493

(51) Int. Cl.[7] ..... B25D 17/00

(52) U.S. Cl. ..... 173/128; 173/133; 173/210; 173/135

(58) Field of Search ..... 173/128, 132, 173/131, 133, 135, 210, 211, 114

(56) References Cited

U.S. PATENT DOCUMENTS

| | | | | |
|---|---|---|---|---|
| 2,094,184 | * | 9/1937 | Noble | 173/128 |
| 2,936,743 | * | 5/1960 | Colgate | 173/128 |
| 5,060,734 | * | 10/1991 | Anderson et al. | 173/128 |
| 5,431,235 | * | 7/1995 | Drumheller et al. | 173/128 |
| 5,878,823 | * | 3/1999 | Henriksson | 173/128 |
| 5,896,934 | * | 4/1999 | Yaniero et al. | 173/128 |

FOREIGN PATENT DOCUMENTS

| | | |
|---|---|---|
| 0 144 282 | 6/1985 | (EP) . |
| 952935 | 12/1996 | (FI) . |
| 2 171 948 | 9/1986 | (GB) . |

* cited by examiner

*Primary Examiner*—Scott A. Smith
(74) *Attorney, Agent, or Firm*—Smith-Hill and Bedell

(57) ABSTRACT

The invention relates to an arrangement in connection with a hydraulic breaking apparatus, the arrangement comprising a housing (4) placed around a percussion hammer (1), and a changeable wearing element (6) arranged at the lower part of the housing. The wearing element (6) receives blows and forces directed at the lower part of the housing (4). The wearing element (6) is fastened in such a way that it can be detached and changed easily and rapidly, if required. Further, the structure of the breaking apparatus may also be such that when the wearing element (6) is removed, it is possible to carry out the maintenance and repair operations of the lower frame **(1*b*) of the percussion hammer without disassembling the upper frame (1*a*)** of the percussion hammer.

8 Claims, 2 Drawing Sheets

ARRANGEMENT IN CONNECTION WITH A HYDRAULIC BREAKING APPARATUS

Figure 1:
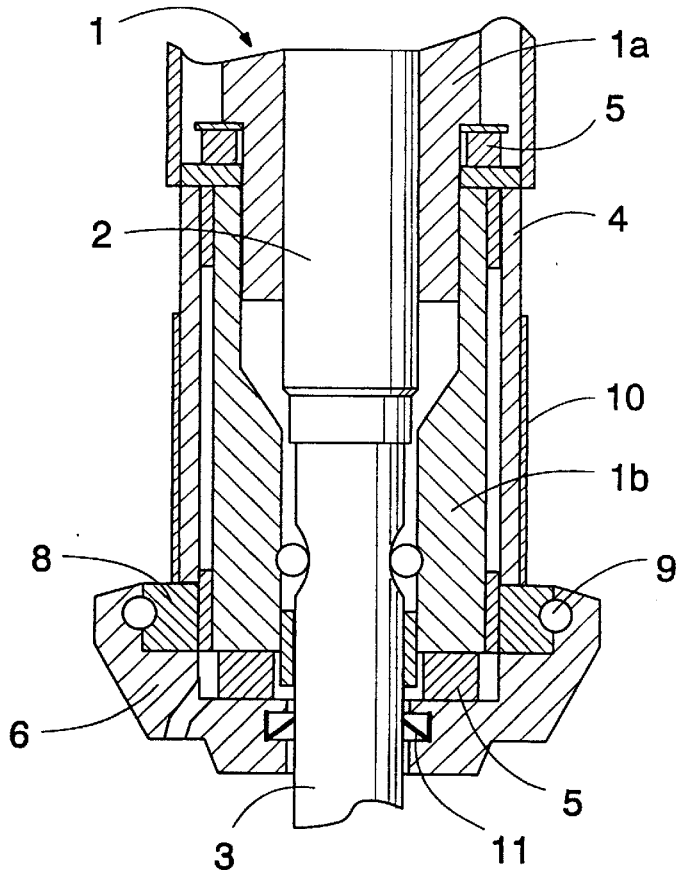

The invention relates to an arrangement in connection with a hydraulic breaking apparatus comprising a tool, the arrangement comprising a housing placed around a percussion hammer.

Hydraulic breaking apparatuses, such as percussion hammers, are generally used to break relatively hard materials, for example stone, concrete, asphalt, frozen soil, metal slag etc. Percussion hammers are usually installed as auxiliary equipment in excavators instead of buckets, and they are usually operated by the hydraulics of the base machine. Other base machines and carriers can also be used. During breaking, dust and other impurities spread from the material to be broken to the surroundings, causing thus problems in the operation and durability of the breaking apparatus. Breaking apparatuses are also used and stored in demanding conditions. Therefore, in order to block the access of dust and other impurities to the structures of the breaking apparatus, the apparatus is usually enclosed within a housing. The housing also protects the percussion apparatus against external blows and weather conditions. Further, noise and vibration are diminished substantially when the percussion hammer is placed inside a housing and also supported thereto by means of damping elements.

However, there have been problems with the present breaking apparatuses as regards the durability of the housings. The lower ends of the housings are continuously subject to damages since during the breaking the tool of the breaking apparatus is pressed against the object to be broken and when the object yields and breaks under the tool, the breaking apparatus moves suddenly towards the object to be broken due to a feed force. In such a case, the lower end of the housing often collides with the surface to be broken. In time the lower end of the housing will no longer withstand this, but it will be damaged. There will be fractures and cracks in the housing, and impurities can have access to the broken housing through these openings, causing damage to the percussion apparatus. It is also possible that the housing is damaged to such an extent that the operation of the breaking apparatus will be prevented completely. Sometimes the operator of the breaking apparatus also uses the apparatus to move broken rocks and the like away from the place of breaking, which means that the lower part of the housing will also be subjected to blows. Consequently, the lower part of the housing is subjected to rather great stresses during the use of the apparatus. Therefore, it is necessary to repair the housings at times by straightening and welding. However, this produces additional costs and the breaking apparatus is out of productive use for long periods of time. On the other hand, it is not necessarily reasonable to manufacture the housing from a stronger sheet or to massively reinforce it in some other manner, since in such a case the breaking apparatus will be heavier and bigger and therefore more difficult to handle. Even though the material thickness were increased, the structure would still contain welded seams, joints and other points that are crucial for breakage.

The purpose of the present invention is to prevent the prior art drawbacks and to provide better protection for the lower end of a hydraulic breaking apparatus than previously.

The arrangement according to the invention is characterized in that the lower part of the housing is provided with a changeable wearing element receiving blows and forces directed at the lower part of the housing and forming the lower part of the housing, the tool being conducted through said wearing element.

The basic idea of the invention is that the lower end of the housing in a hydraulic breaking apparatus is provided with a separate wearing element that can be changed easily and that receives blows and forces directed at the lower part of the housing. Further, the wearing element forms the lower end of the housing and therefore the tool is conducted through the wearing element. The basic idea of an embodiment of the invention is that the wearing element is provided with a suitable protruding section or some other part that can be utilized in the breaking. Moreover, the basic idea of a second embodiment of the invention is that the wearing element locks the lower frame of the percussion hammer inside the housing.

The invention has the advantage that due to the wearing element the housing requires substantially less repairs. Also, changing the wearing element takes only a fraction of the time required previously by the straightening and repair welding of the housing. A changeable wearing element can be changed rapidly and the changing does not require special skills or tools. Therefore it can be changed even on the construction site, which means that the breaking apparatus will be out of use for as little time as possible due to maintenance. Another advantage is that the breaking apparatus can be provided, if required, with a wearing element that is manufactured for a specific use. For example a wearing element that is provided with a stone claw facilitating the removal of rocks and the like makes the breaking faster and easier when cumbersome rocks can be moved out of the way and the tool of the breaking apparatus can be directed at exactly the correct point on the surface to be broken. Further, the durability of the entire breaking apparatus is improved when there will no longer be any small cracks in the welded seams and joints of the housing through which impurities could have access to the housing to damage the seals and structures. Such a hidden flow of impurities to the percussion hammer that the operator is unaware of and that takes place over long periods of time can now be prevented. Another advantage is that the sealing of the tool of the breaking apparatus is realized in the changeable wearing element, which means that the seal that is subjected the most to dust and other impurities and that therefore also wears out most rapidly is changed at the same time as the wearing element. Further, the advantage of another embodiment of the invention is that during the maintenance of the breaking apparatus the wearing element can be detached rapidly from its fastening to provide fast access to the lower frame of the percussion hammer. After the wearing element has been detached, the lower part of the percussion hammer can be removed and repaired without disassembling the upper part of the percussion hammer. Also, the wearing element according to the invention does not hinder the use of the apparatus in any way nor does it complicate changing of the tool, for example, and it can be used in connection with most breaking apparatuses.

Figure 2:
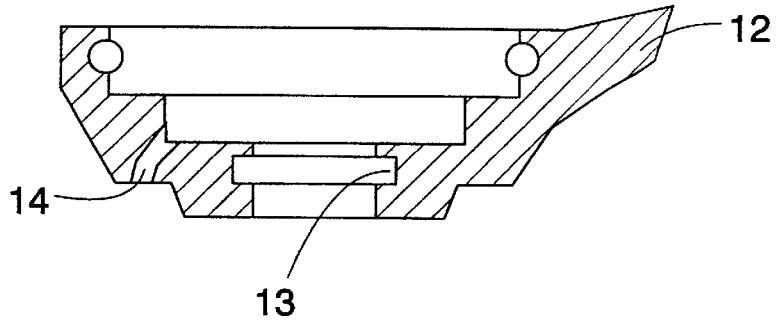
Figure 3:
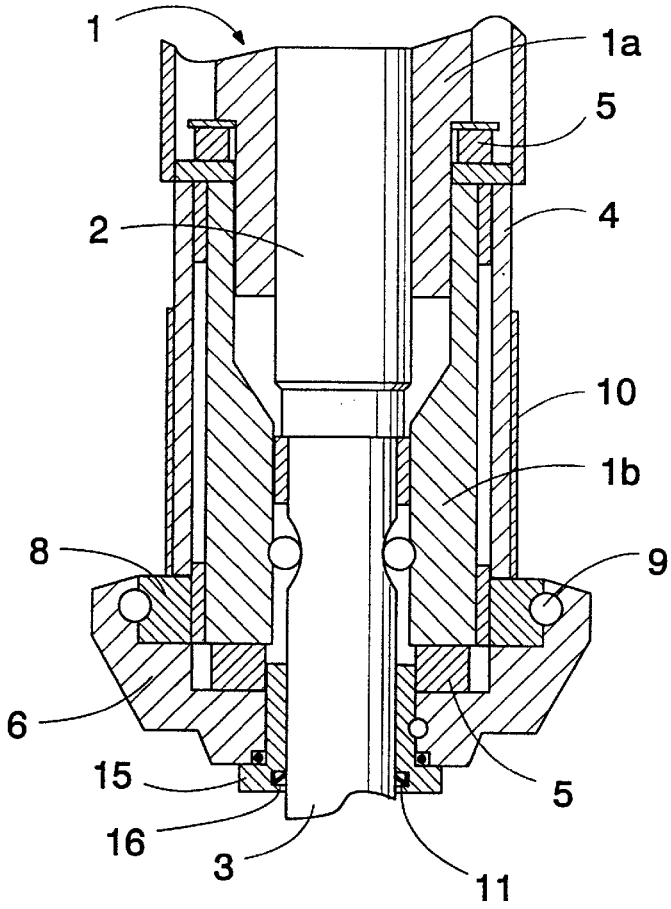
Figure 4:
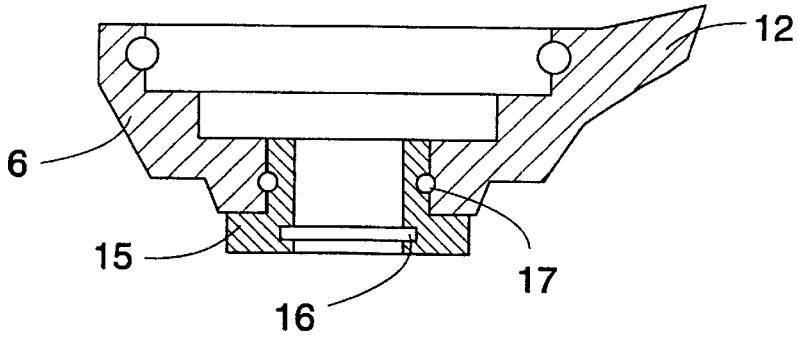

The invention will be described in greater detail in the accompanying drawings, in which FIG. 1 shows schematically a sectional side view of a lower end of a hydraulic breaking apparatus provided with a changeable wearing element according to the invention, FIG. 2 shows schematically a cross-sectional side view of a changeable wearing element according to the invention, FIG. 3 is a sectional side view of another lower end of a hydraulic breaking apparatus according to the invention, and FIG. 4 shows schematically a cross-sectional side view of another changeable wearing element according to the invention.

FIG. 1 shows schematically a breaking apparatus provided with a changeable wearing element according to the invention. The breaking apparatus or hydraulic impact hammer can be attached to a boom in an excavator, for example, or in some other construction machine in a manner known per se that is not shown in the figure. The percussion hammer 1 is shown in the figure in a very simplified form, since the structure and operation of the apparatus are known in the field and they are not significant for the present invention. It should be mentioned, however, that the percussion hammer 1 comprises a hydraulically reciprocating percussion piston 2 that directs consecutive blows via a tool 3 at the object to be broken. The actual breaking takes place by pressing the tool 3 against the surface to be broken and by delivering blows with the percussion piston 2 to the tool 3 and from there to the surface to be broken. The percussion hammer of the breaking apparatus shown in the figure has two parts and it consists of an upper frame 1*a* and a lower frame 1*b*. The percussion hammer 1 is surrounded by a housing 4, which may consist of for example steel sheets that have been bent and coupled together. The housing 4 is usually provided with at least one side that can be opened easily for the purpose of maintenance operations. The housing 4 is also provided with seals, so that impurities do not have access to the interior of the housing via lead-through holes and joints of the openings. The basic structure of the housing 4 can be implemented in several ways but it is not necessary to describe them in greater detail in this connection. Between the housing 4 and the percussion hammer 1 there are damping elements 5 that effectively dampen, together with the housing 4, the noise and vibration produced during the breaking. The damping elements 5 are made of, for example, rubber or some other elastic material. The essential feature is that the lower part of the housing 4 is protected by a changeable wearing element 6 that receives blows and forces directed at the housing 4. In the arrangement shown in the figure, the wearing element 6 forms alone the lower end of the housing 4 and therefore it also locks the lower frame 1*b* of the percussion hammer in place, preferably supported by the damping elements 5. Since the lower frame 1*b* can be detached and maintained via the open lower end of the housing 4 after the wearing element 6 has been removed, it is not absolutely necessary to provide the housing with a separate opening for maintenance operations. Therefore, the manufacturing costs of the housing are lower and its structure will be more rigid and better sealed. A sleeve 8 is welded to the lower end of the housing 4 for the purpose of mounting the wearing element 6. Both the sleeve 8 and the wearing element 6 are provided with openings for the purpose of fastening the wearing element 6, and fastening means 9, such as bolts, pins or the like, that lock the wearing element 6 in place can be positioned in these openings. The fastening means 9 extend preferably through both the wearing element and the sleeve. The side walls of the housing may also be covered, at a section of their length, by side shields 10. In the embodiment of FIG. 1, the percussion hammer 1 rests in whole inside the housing, and only the tool 3 protrudes via the wearing element 6 fastened to the lower part of the housing 4. The section between the wearing element 6 and the tool 3 is sealed by means of a seal 11 placed in the wearing element 6.

FIG. 2 is a cross-sectional side view of a wearing element according to the invention. The reference numerals in FIG. 2 correspond to those in FIG. 1. The wearing element shown in FIG. 2 corresponds otherwise to the wearing element shown in FIG. 1 except that it also comprises a projection 12 at least on one side of the element. Such a projection 12, which is a kind of stone prod, can be used in the breaking or the removal of rocks. Naturally the wearing element 6 can also be designed in several other ways for a desired purpose. The wearing element is most preferably produced by casting, but it can naturally also be machined. The wearing element is produced from wear-resistant steel, but depending on the use and situation, other materials may also be possible. The wearing element is also provided with a seal groove 13 for the seal 11 placed at the root of the tool 3. Further, the wearing element can be provided with necessary ducts 14 to which connectors or other components can be screwed to be ready. The wearing element can also be attached to the lower part of the housing in several other manners than by means of the fastening bolts 9 shown in the figures. The fastening may also be a bayonet connection, an interlocking connection or for example a threaded connection. There are several possible alternatives. The essential feature is that the wearing element can be fastened firmly but also easily and rapidly.

FIG. 3 shows another structure of the lower end of the hydraulic breaking apparatus. The arrangement shown in the figure corresponds otherwise to the one shown in FIG. 1 except that in FIG. 3 the wearing element 6 is provided with a separate tool guide 15, which is preferably a sleeve-like element. The tool guide 15 is provided with a seal groove 16 for the seal 11 of the tool 3. The tool guide 15 may be fastened to the wearing element 6 for example in the same way as the wearing element 6 is attached to the sleeve 8. Such a sleeve-like tool guide 15 is produced separately from the wearing element 6 and since it is a simple body of revolution, it is easy and fast to machine it accurately. Correspondingly, the actual wearing element does not require a great deal of machining. Further, this structure has the advantage that the tool guide 15 provides good support for the tool 3 at the lower end of the housing 4 since it can extend over a required distance toward the upper part of the housing 4 in the longitudinal direction of the tool 3, as shown in the figure.

FIG. 4 shows a wearing element 6 provided with a tool guide 15. If required, it is possible to change the entire structure shown in the figure or only the tool guide 15 or the wearing element 6. A structure utilizing a separate tool guide 15 also enables a wider selection of materials and shapes for the actual wearing element 6.

The drawing and the description related thereto are only intended to illustrate the inventive idea. The details of the invention may vary within the scope of the claims. Therefore, the wearing element may also comprise a section that covers better the side walls of the housing and that may be provided with for example shield plates that are parallel to the sides of the housing. Between the tool guide 15 or the lower tool bushing and the tool there may be a seal 11 placed in the lower tool bushing, and between the lower tool bushing and the wearing element there is a separate seal 17 that may be placed either in the lower tool bushing or in the wearing element. In such a case, it is not necessary to provide a seal at the root of the tool in the wearing element, but if such a seal is used in addition to the tool seal placed in the lower tool bushing, the lower part of the housing is sealed particularly well. The seal positioned against the tool in the wearing element acts then as a dust cover.

What is claimed is:

1. A hydraulic impact breaker comprising a percussion hammer, a housing positioned around the percussion hammer, and a tool which is positioned to be struck by the percussion hammer, and wherein the housing comprises an upper part which surrounds the percussion hammer and a lower part through which the tool extends, and wherein the lower part of the housing includes a wearing element which is rigidly attached to the upper part of the housing in a manner permitting detachment from the upper part of the housing, whereby the wearing element can be removed and replaced, the wearing element being positioned to receive blows and forces directed at the lower part of the housing, to protect the housing, and being formed with a passage through which the tool extends and through which the tool moves without being influenced substantially by the wearing element with respect to axial movement, and wherein the percussion hammer includes a lower frame in which the tool is mounted and a percussion pistion for striking the tool, and wherein, when the wearing element is mounted in place, it is arranged to lock the lower frame of the percussion hammer in place inside the housing.

2. An impact hammer according to claim 1, wherein the wearing element comprises a projection or the like to be used in breaking.

3. An impact hammer according to claim 1, wherein the lower end of the housing is provided with a sleeve for fastening the wearing element, and the sleeve and the wearing element are provided with openings for fastening means.

4. An impact hammer according to claim 1, wherein the wearing element comprises a seal groove for a seal of the tool.

5. An impact hammer according to claim 1, wherein a separate tool guide is attached to the wearing element.

6. An impact hammer according to claim 1, wherein the lower frame of the percussion hammer can be removed via the lower end of the housing after the wearing element has been detached.

7. An impact hammer according to claim 1, wherein the lower frame of the percussion hammer is captive between the wearing element and the upper part of the housing.

8. An impact hammer according to claim 7, further comprising a dampening element interposed between the lower frame of the percussion hammer and the wearing element.

* * * * *